US007252334B2

(12) United States Patent
Hale et al.

(10) Patent No.: US 7,252,334 B2
(45) Date of Patent: Aug. 7, 2007

(54) UNITARY CAM FOR ROCKER-RECLINER BASE ASSEMBLY

(75) Inventors: Kerry Hale, Pontotoc, MS (US); Carthel Hale, Pontotoc, MS (US); Larry J. Bryant, Pontotoc, MS (US); Gregory M. Lawson, Tupelo, MS (US)

(73) Assignee: L & P Property Management Company, South Gate, CA (US)

( * ) Notice: Subject to any disclaimer, the term of this patent is extended or adjusted under 35 U.S.C. 154(b) by 0 days.

(21) Appl. No.: 11/402,533

(22) Filed: Apr. 12, 2006

(65) Prior Publication Data

US 2006/0232113 A1 Oct. 19, 2006

Related U.S. Application Data

(60) Provisional application No. 60/670,791, filed on Apr. 13, 2005.

(51) Int. Cl.
*A47C 3/02* (2006.01)

(52) U.S. Cl. ..... 297/265.1; 297/258.1

(58) Field of Classification Search ..... 5/107, 5/105, 106, 108, 109; 297/272.1, 271.6, 297/259.2, 258.1, DIG. 7, 463.1, 463.2, 261.1, 297/261.2, 261.3, 271.5
See application file for complete search history.

(56) References Cited

U.S. PATENT DOCUMENTS 1,682,685 A * 8/1928 Rodery ..... 297/272.1
1,986,233 A * 1/1935 Weaver ..... 297/247
3,158,877 A * 12/1964 Cooper ..... 5/105
5,839,781 A * 11/1998 Knape ..... 297/258.1
6,000,750 A * 12/1999 Rossman et al. ..... 297/2
6,918,632 B2 * 7/2005 Maki et al. ..... 297/258.1

* cited by examiner

*Primary Examiner*—Milton Nelson, Jr.
(74) *Attorney, Agent, or Firm*—Shook, Hardy & Bacon, LLP

(57) ABSTRACT

A unitary composite cam member is designed for integration into a rocker chair base assembly. In one arrangement, one cam member resides upon each longitudinal rail of the rocker chair base assembly. Each cam member includes a rigid body and one or more laterally projecting sleeves. The rigid body has an upper portion as well as a lower contact surface presenting an arcuate longitudinal profile. The shape of the contact surface enables rolling engagement on a longitudinal rail of a rocker chair base assembly. Each projecting sleeve extends laterally from the rigid body at a location generally near the top of the cam member. The projecting sleeves are designed to provide an attachment point for cross members of a rocker chair base assembly to accomplish coupling together of the cam members with each aligned upon one of the longitudinal rails. Additionally, the projecting sleeves are configured for securing rocker spring assemblies directly therewith to provide improved efficiencies in the fabrication of rocker chair base assemblies.

6 Claims, 2 Drawing Sheets

UNITARY CAM FOR ROCKER-RECLINER BASE ASSEMBLY

CROSS-REFERENCE TO RELATED APPLICATIONS

This application claims priority to commonly owned U.S. provisional application Ser. No. 60/670,791, filed Apr. 13, 2005, incorporated by reference in its entirety.

STATEMENT REGARDING FEDERALLY SPONSORED RESEARCH OR DEVELOPMENT

Not applicable.

BACKGROUND OF THE INVENTION

Rocker chairs, including recliners with a rocking feature, typically have a base assembly for supporting the superstructure of the chair. For instance, FIG. 1 shows an exemplary multi-bar linkage system 10 of a rocker-recliner chair frame that controls the positioning of an overlying seat upon which a chair occupant sits. The linkage system 10 allows a person to apply backward pressure while seated to move the frame of the chair into a reclined position and downward pressure on a foot support of the frame to return the chair frame to the upright seated position. A lower portion 12 of the linkage system 10 is connected to a rocker chair base assembly 20 that allows the chair occupant to rock back and forth in a forward and backward motion similar to a standard rocking chair.

A left side portion of a conventional rocker chair base assembly 20 is shown in FIG. 1, with the right side generally being a mirror image of the left side. The rocker chair base assembly 20 includes a pair of cam assemblies 30, one on the left side portion of the assembly 20 and one on the right side portion of the assembly 20. The cam assemblies 30 provide the interface between the linkage system 10 and a set of spaced apart left side and right side longitudinal rails 40 that support the chair on a floor. Additionally, the base assembly 20 includes a set of cross tubes 50 interconnecting the cam assemblies 30 and a pair of rocker spring assemblies 60 mounted with the cross tubes 50 for regulating the degree of forward and backward rocking motion of the cam assemblies 30 on the longitudinal rails 40. Each cam assembly 30 is formed by an L-shaped upper bracket 32 welded to the longitudinal ends of an upper pair 52 of the cross tubes 50 and a lower wooden cam member 34 attached to the upper bracket 32, with the upper bracket 32 welded or otherwise secured with linkage system lower portion 12. The cam member 34 has a generally arcuate contact surface for rolling engagement with an upper flat surface of the respective longitudinal rail 40.

Despite the widespread use of the aforementioned cam assemblies 30, the conventional design has a number of drawbacks. First, the contact surface of a wooden cam member 34 tends to distort over repeated load cycles, leading to a flattening of the arcuate shape and an inconsistent rocking pattern. This flattening effect may be exacerbated by hardness variations present in a section of wood selected to form the cam member 34. Another problem with the conventional cam assembly design is installation on a rocker chair base assembly 20. The metal upper bracket 32 is usually welded to the cross tubes 52, which is time consuming and labor intensive, and may result in imprecise lateral positioning of the cam assemblies 30 on the longitudinal rails 40. Further, attaching the upper bracket 32 and cam member 34 together with fasteners may result in weakening of the wood near the point of attachment, shortening the life of the cam assembly 30. Some of the problems associated with using fasteners can be avoided by the use of adhesives to secure the upper bracket 32 with a top surface of the cam member 34. However, adhesives are themselves often subject to failure over time. Additionally, even with adhesives, precise assembly steps are still required to avoid misalignment of the cam member 34 relative to the longitudinal rails 40. As can be seen, fabrication of a conventional rocker chair base assembly 20 incorporating the aforementioned cam assembly 30 design is a labor intensive and time consuming process.

SUMMARY OF THE INVENTION

A unitary composite cam member of the present invention provides a rocker chair base assembly with more reliable performance and durability. Improved installation ease of the rocker chair base assembly with other components of a rocker-recliner chair is also realized. In one aspect, a pair of cam members are integrated into the design of a rocker chair base assembly, each cam member including a rigid body and one or more laterally projecting sleeves in a unitary design. The rigid body has an upper portion as well as a lower contact surface presenting an arcuate longitudinal profile. The shape of the contact surface enables rolling engagement on a longitudinal rail of a rocker chair base assembly. Each projecting sleeve extends laterally from the rigid body at a location generally near the top of the cam member. The projecting sleeves are designed to provide an attachment point for cross members of a rocker chair base assembly to accomplish coupling together of a pair of spaced apart cam members for alignment upon longitudinal rails of the base assembly. Additionally, the projecting sleeves are configured for securing rocker spring assemblies directly therewith to provide improved efficiencies in the fabrication of rocker chair base assemblies. In another aspect, the cam member has a vertically oriented web portion with a series of strengthening ribs formed on the web. Such a design incorporating the web portion and strengthening ribs provides a lightweight cam member with sufficient strength to handle repeated cycle loading of the rocker-recliner chair occupant engaging in a rocking motion.

Additional advantages and features of the invention will be set forth in part in a description which follows, and in part will become apparent to those skilled in the art upon examination of the following, or may be learned by practice of the invention.

BRIEF DESCRIPTION OF THE SEVERAL VIEWS OF THE DRAWINGS

In the accompanying drawings, which form a part of the specification and are to be read in conjunction therewith and in which like reference numerals are employed to indicate like parts in the various views.

DETAILED DESCRIPTION OF THE INVENTION

Figure 2:
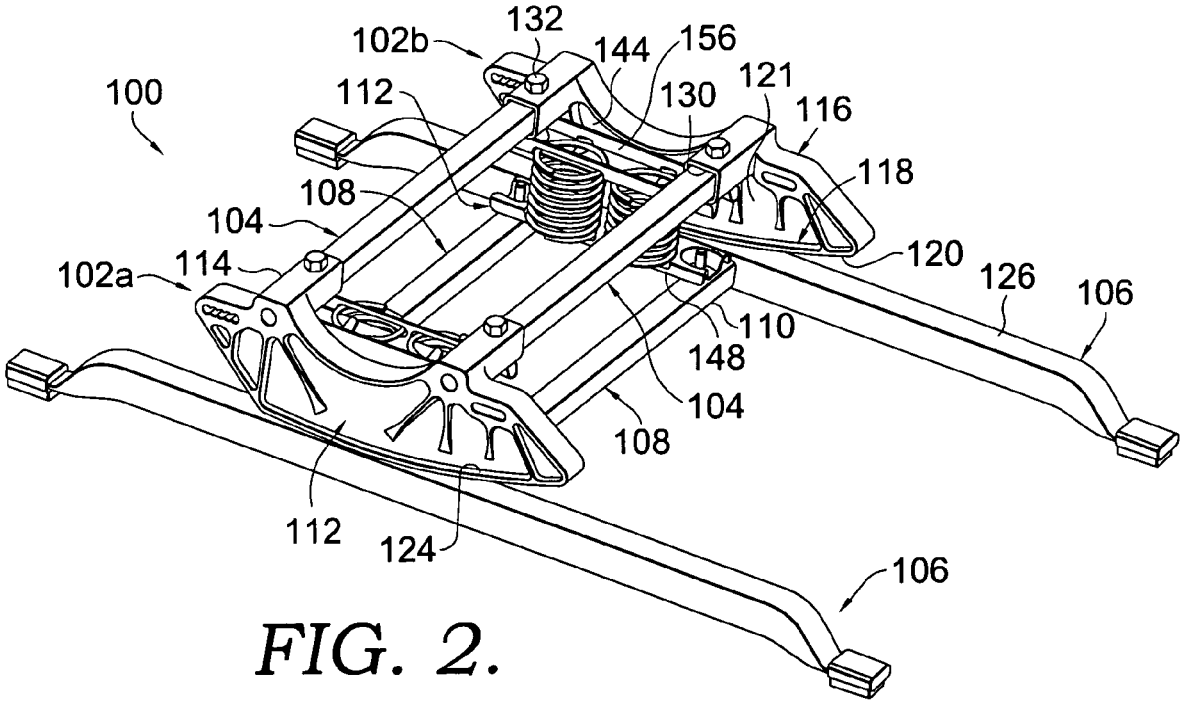
FIG. 2 is perspective view of a rocker chair base assembly incorporating a pair of unitary cam members in accordance with one embodiment of the present invention.

Turning now to the drawings, and in particular to FIG. 2, a rocker chair base assembly 100 is illustrated that incorporates a set of unitary cam members 102, also referred to herein as cam members 102*a* and 102*b*. The cam members 102 are interconnected with one another through a set of upper cross tubes 104 for proper positioning of each cam member 102 upon one of a set of parallel longitudinal rails 106 of the base assembly 100. In this way, the longitudinal rails support a forward and rearward rocking motion on the rails 106 by the cam members 102, with the cam members 102 supporting the weight of the chair frame and other superstructure of a rocker-recliner chair (not shown). The rocker chair base assembly 100 further includes a set of lower cross tubes 108 connected on opposed longitudinal ends 110 with the longitudinal rails 106 and a set of rocking motion limiting mechanisms in the form of rocker spring assemblies 112. Each rocker spring assembly 112 is coupled with the lower cross tubes 108 and with the upper cross tubes 104 through one of the cam members 102, as will be more fully explained herein. The cross tube longitudinal ends 110 may be attached to the longitudinal rails 106 by welding or other attachment means.

The cam members 102 are preferably formed as rigid composite structures from polymeric material. For instance, the cam members 102 may be formed of glass-filled nylon, polypropylene, or a combination of the these materials. Other materials may be selected as a matter of design choice. The composite cam members 102 may be formed by molding processes, such as injection molding, and certain portions of the cam members 102 may be machined to form the finished product. The composite nature of the cam members 102 allow for improved integration into a rocker chair base assembly 100, resulting in shorter assembly times and a more reliable product. The use of composite materials enables the cam members 102 to be manufactured to tight tolerances and with consistent material properties throughout the structure. Furthermore, composite cam members provide the advantage of being able to withstand repeated loading cycles while maintaining sufficient structural integrity.

Figure 3:
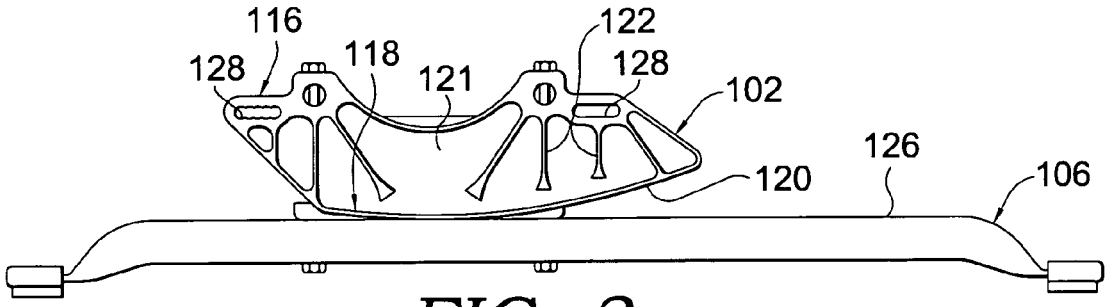
FIG. 3 is a side elevational view of the rocker chair base assembly incorporating the unitary cam members.

With continued reference to FIG. 2, each of the cam members 102 has a main body 112 and a set of projecting sleeved arms 114 extending laterally from the main body 112. The main body 112 of each cam member 102 includes an upper portion 116 from which the sleeved arms 114 project, a lower portion 118 where a contact surface 120 is formed, and a vertically oriented web 121 spanning between the upper portion 116 and the lower portion 118, which can be seen in further detail in FIG. 3. The web 121 has a plurality of strengthening ribs 122 extending generally from the upper portion 116 to a location at or near the lower portion 118 to aid in carrying the vertical load induced by the chair occupant and the weight of the chair. Preferably, some of the ribs 122 do not extend downwardly to the contact surface 120, as typical molding processes for the cam member 102 could result in the ribs 122 creating small deflections in the contact surface 120 that may be felt by the chair occupant during a rocking motion on the longitudinal rails 106. In one embodiment, to balance the need for reinforcement of the web 121 provided by the ribs 122 with the desire to avoid having the chair occupant feel deflections in the contact surface 120 caused by the ribs 122, the only ribs 122 that extend completely to the flange 124 that forms the contact surface 120 are those near the forward and rearward end of the surface 120 that would not be felt during a significant portion of the rocking motion.

For a smooth rocking motion, the contact surface 120 of the cam member 102 has an arcuate longitudinal profile. As such, the contact surface 120 is configured to move in rolling engagement with a top surface 126 of the longitudinal rails 106. Optionally, a powder coat may be applied to the top surface 126 of the longitudinal rails 106 in order to increase the friction between the top surface 126 and the contact surface 120 to reduce slippage during rocking.

Figure 1:
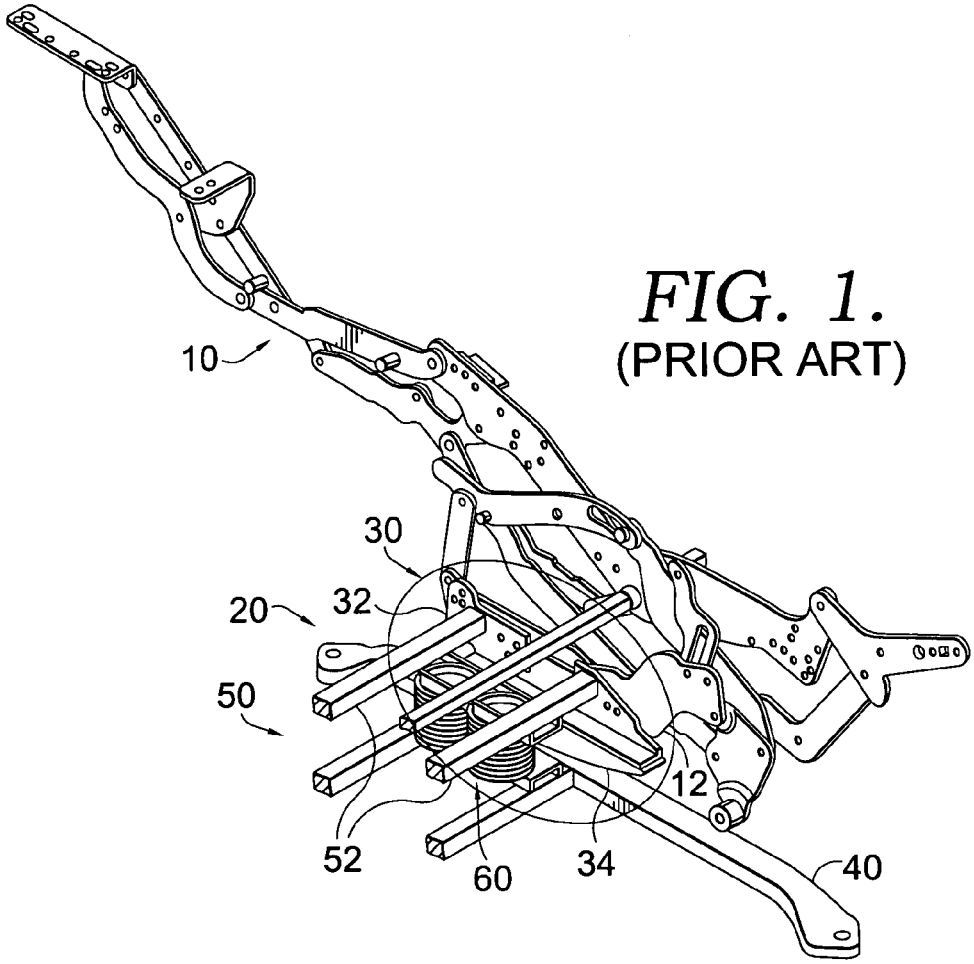
FIG. 1. (PRIOR ART)
FIG. 1 is a fragmentary perspective view of a portion of a conventional rocker-recliner chair frame with the encircled region designating a prior art cam assembly.

Laterally oriented through holes 128 are generally positioned at the upper portion 116 of the main body 112 to serve as attachment points for the rocker-recliner chair frame (e.g., multi-bar linkage system 10 of FIG. 1) to couple with the rocker chair base assembly 100 through each cam member 102. For instance, fasteners may be inserted into the through holes 128 and through a feature of the rocker-recliner chair frame to accomplish coupling with the rocker chair base assembly 100. Those of skill in the art will appreciate that other attachment means may be selected.

In assembly, longitudinal end regions 130 of the upper cross tubes 104 are inserted into the sleeved arms 114 and vertically oriented apertures (not shown) of both the cross tubes 104 and the sleeved arms 114 are aligned so that a fastener 132 inserted therethrough secures one of the tube end regions 130 within one of the sleeved arms 114. This particular design also ensures proper lateral alignment between the contact surface 120 of the cam member 102 and the top surface 126 of the longitudinal rails 106 by selecting upper cross tubes 104 of an appropriate length.

Figure 4:
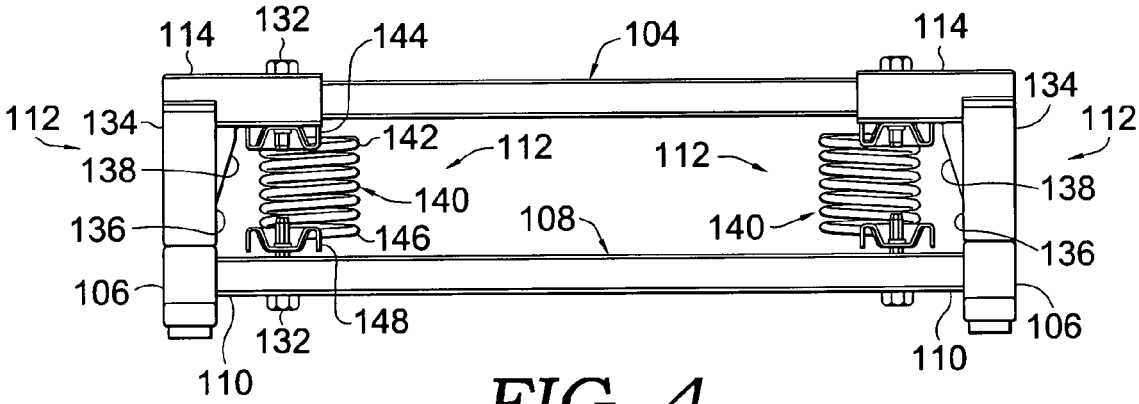
FIG. 4 is a front elevational view of the rocker chair base assembly incorporating the unitary cam members.

In one embodiment of the rocker chair base assembly 100 illustrated in FIG. 2, one of the cam members 102*a* has sleeved arms 114 projecting laterally to the left and the other cam member 102*b* has sleeved arms 114 projecting laterally to the right (according to the orientation of a chair occupant), so that the sets of sleeved arms 114 on the opposed cam members 102*a*, 102*b* are directed towards one another. With reference to FIGS. 2 and 4, outward facing and inward facing lateral side regions 134, 136 of each cam member 102 are mirror images of one another, except that the inward facing region 136 includes the sleeved arms 114 as well as a brace 138 extending from the vertically oriented web 121 to support each sleeved arm 114.

Figure 5:
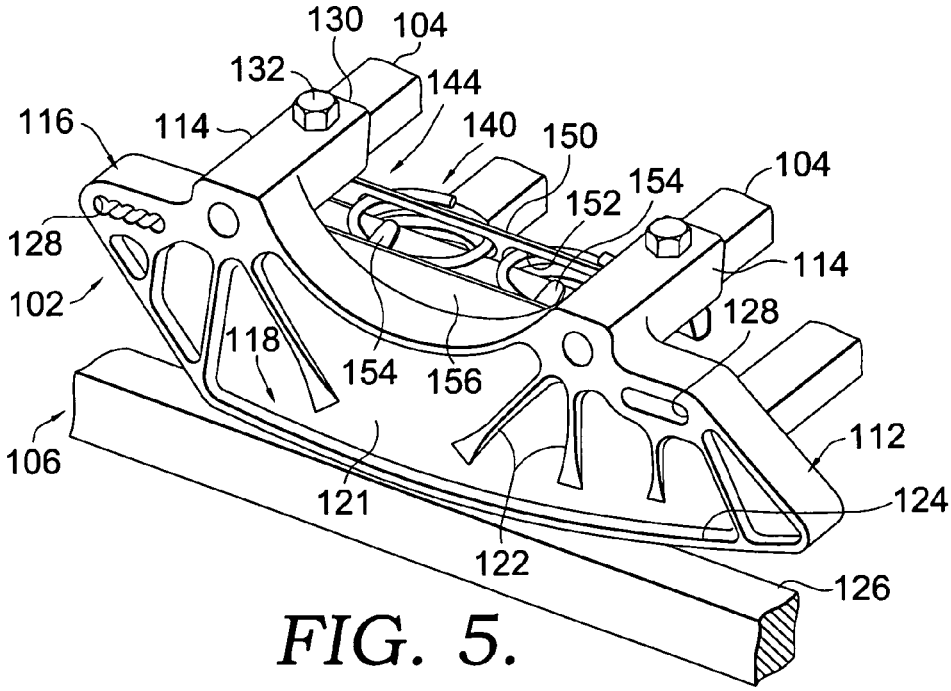
FIG. 5 is a close-up fragmentary perspective view of a portion of the rocker chair base assembly showing one of the unitary cam members.

As seen in further detail in FIG. 4, and with reference to FIG. 5, each rocker spring assembly 112 is secured between the sleeved arms 114 of one cam member 102 and the lower cross tubes 108. The spring assemblies 112 each include a pair of spring coils 140 with an upper portion 142 thereof coupled with an upper bushing 144 and a lower portion thereof 146 coupled with a lower bushing 148. With continued reference to FIG. 2, each lower bushing 148 spans between the lower cross tubes 108 and each upper bushing 144 spans between the sleeved arms 114 at the point of attachment with the upper cross tubes 104. The upper bushing 144 and lower bushing 148 are mounted to the sleeved arms 114 and the lower cross tubes 108, respectively, with fasteners 132. This design provides the advantage of a single assembly step for mounting both the upper cross tubes 104 and the upper bushings 144 to the sleeved arms 114 by use of the fasteners 132.

The coupling of the upper and lower portions 142, 146 of the spring coils 140 with the respective upper and lower bushings 144, 148 is best seen in FIG. 5. Each of the bushings 144, 148 has a first sidewall 150 formed with an aperture 152 through which the spring coil upper and lower portions 142, 146 extend. A pair of clips 154 extend from a second sidewall 156 of the bushings 144, 148 to aid in holding the spring coils 140 in place.

Those of skill in the art will appreciate that one or more additional cam members 102 and a corresponding number of longitudinal rails 106 may be integrated into the design of the rocker chair base assembly 100. For instance, another parallel longitudinal rail 106 may be positioned between the existing rails 106 with a split in the lower cross tubes 108 where the additional rail 106 may be located. In such a design, each additional cam member 102 would have modified sleeved arms 114 to allow sliding of the arms 114 onto the upper cross tubes 104 or the receiving by the arms 114 of upper cross tube sections 104 in opposed lateral directions.

As can be understood, the unitary cam member 102 design of the present invention provides a durable product that is well integrated with other components of a rocker chair base assembly 100. The cam members 102 facilitate ease of manufacture of a rocker chair base assembly 100 with a reliably positioned interface between the cam member contact surface 120 and the longitudinal rails 106 which support the rocking motion.

Furthermore, since certain changes may be made in the above invention without departing from the scope hereof, it is intended that all matter contained in the above description or shown in the accompanying drawing be interpreted as illustrative and not in a limiting sense. It is also to be understood that the following claims are to cover certain generic and specific features described herein.

What is claimed is:

1. In combination, two or more unitary, single piece composite cam members coupled with a rocker chair base assembly including longitudinal rails, at least one cross member, and a rocking motion limiting mechanism, each cam member comprising:

a rigid body having a lower contact surface presenting an arcuate longitudinal profile enabling rolling engagement on one of the longitudinal rails; and at least one projecting arm extending laterally from the rigid body at a location generally above the lower contact surface and adapted for secure attachment with the at least one cross member for coupling the respective cam member with another one of the cam members and with the base assembly.

2. The combination of claim 1, wherein each projecting arm of the cam members comprises a projecting sleeve adapted for slidably receiving therein one cross member.

3. The combination of claim 2, wherein the rocking motion limiting mechanism comprises at least one rocker spring assembly, each projecting sleeve of the cam members having an aperture extending therethrough for receiving a fastener to rigidly connect the respective cam member through the projecting sleeve with one cross member and one rocker spring assembly.

4. The combination of claim 1, wherein the rigid body of each cam member further includes an upper portion, the at least one projecting arm extending laterally from the upper portion of the rigid body.

5. The combination of claim 1, wherein the rigid body of each cam member further includes:

an upper portion;

a vertically oriented web extending between the upper portion and the lower contact surface; and a plurality of strengthening ribs formed on the web.

6. The combination of claim 5, wherein at least some of the plurality of strengthening ribs extend downwardly from the upper portion to a termination point above the lower contact surface of the rigid body of each cam member.

* * * * *